US009159520B2

(12) United States Patent
Carpenter et al.

(10) Patent No.: US 9,159,520 B2
(45) Date of Patent: Oct. 13, 2015

(54) MICROWAVE DRIVEN ELECTRODELESS LAMP COMPRISING MAGNETRON WITHOUT FORCED CONVECTIVE COOLING

(71) Applicants: Paul Carpenter, Northamptonshire (GB); Andrew Simon Neate, Near Leighton Buzzard (GB)

(72) Inventors: Paul Carpenter, Northamptonshire (GB); Andrew Simon Neate, Near Leighton Buzzard (GB)

(73) Assignee: Ceravision Limited, Milton Keynes (GB)

( * ) Notice: Subject to any disclaimer, the term of this patent is extended or adjusted under 35 U.S.C. 154(b) by 0 days.

(21) Appl. No.: 14/350,289

(22) PCT Filed: Oct. 5, 2012

(86) PCT No.: PCT/GB2012/000764

§ 371 (c)(1),
(2) Date: Apr. 7, 2014

(87) PCT Pub. No.: WO2013/050730

PCT Pub. Date: Apr. 11, 2013

(65) Prior Publication Data

US 2014/0246971 A1 Sep. 4, 2014

(30) Foreign Application Priority Data

Oct. 7, 2011 (GB) ..... 1117409.1
Apr. 13, 2012 (GB) ..... 1206554.6

(51) Int. Cl.
*H01J 1/02* (2006.01)
*H01J 7/24* (2006.01)

(Continued)

(52) U.S. Cl.
CPC ..... *H01J 19/36* (2013.01); *F21V 29/74* (2013.01); *H01J 65/04* (2013.01); *H01J 65/044* (2013.01); *F21S 8/086* (2013.01); *F21V 29/507* (2013.01)

(58) Field of Classification Search
CPC ..... H01J 65/044; H01J 65/04; H01J 19/36; F21V 29/74; F21V 29/507; F21S 8/086
USPC ..... 313/113, 45–47, 161, 572; 315/248, 39, 315/73–74
See application file for complete search history.

(56) References Cited

U.S. PATENT DOCUMENTS

| | | | | |
|---|---|---|---|---|
| 3,369,597 | A | 2/1968 | Dronsuth et al. | |
| 6,617,806 | B2 | 9/2003 | Kirkpatrick et al. | |
| 2002/0030453 | A1 * | 3/2002 | Kirkpatrick et al. | 315/248 |
| 2002/0105276 | A1 | 8/2002 | Jeon | |
| 2006/0087257 | A1 | 4/2006 | Choi | |
| 2011/0006681 | A1 * | 1/2011 | Preston et al. | 315/39 |

FOREIGN PATENT DOCUMENTS

| | | |
|---|---|---|
| EP | 1 335 408 | 8/2003 |
| KR | 20070017832 | 2/2007 |

(Continued)

*Primary Examiner* — Anne Hines
*Assistant Examiner* — Jose M Diaz
(74) *Attorney, Agent, or Firm* — Bay State IP, LLC

(57) ABSTRACT

A LUWPL luminaire has a housing with a lower transparent closure and a heat dissipating top of cast aluminum. This has a suspension eye. The housing has an upper flange via which it is bolted with the interposition of a seal to a underside rim of the top. Within the rim, the underside is substantially flat, with a magnetron attachment boss and other attachment points. A magnetron is supported by being clamped by a saddle to the attachment boss at the magnetron's anode. The magnetron is fast with a transition box and a crucible support block. A bracket fixed to certain of the attachment points extends down from the top is screwed to the transition box. Thus the LUWPL parts are securely supported below the top.

17 Claims, 16 Drawing Sheets

(51) Int. Cl.

| | |
|---|---|
| ***H01J 61/52*** | (2006.01) |
| ***H01K 1/58*** | (2006.01) |
| ***H01J 19/36*** | (2006.01) |
| ***H01J 65/04*** | (2006.01) |
| ***F21V 29/74*** | (2015.01) |
| *F21S 8/08* | (2006.01) |
| *F21V 29/507* | (2015.01) |

(56) References Cited

FOREIGN PATENT DOCUMENTS

| | | |
|---|---|---|
| WO | 2011015807 | 2/2011 |
| WO | 2011020989 | 2/2011 |

* cited by examiner

MICROWAVE DRIVEN ELECTRODELESS LAMP COMPRISING MAGNETRON WITHOUT FORCED CONVECTIVE COOLING

CROSS REFERENCE TO RELATED APPLICATION

This application is for entry into the U.S. National Phase under §371 for International Application No. PCT/GB2012/000764 having an international filing date of Oct. 5, 2012, and from which priority is claimed under all applicable sections of Title of the United States Code including, but not limited to, Sections 120, 363, and 365(c), and which in turn claims priority under 35 USC 119 to United Kingdom Patent Application No. 1117409.1 filed on Oct. 7, 2011 and United Kingdom Patent Application No. 1206554.6 filed on Apr. 13, 2012.

BACKGROUND OF THE INVENTION

1. Field of the Invention

The present invention relates to a light source.

We have developed technology for the production of light via plasma excitation in a Lucent Waveguide electromagnetic Wave Plasma Light source. We refer to this technology as LUWPL technology.

2. Description of the Related Art

We define a LUWPL source as having:

- a fabrication of solid-dielectric, lucent material, having;
  - a closed void containing electro-magnetic wave, normally microwave, excitable material; and
- a Faraday cage:
  - delimiting a waveguide,
  - being at least partially lucent, and normally at least partially transparent, for light emission from it,
  - normally having a non-lucent closure and
  - enclosing the fabrication;
- provision for introducing plasma exciting electro-magnetic waves, normally microwaves, into the waveguide;

the arrangement being such that on introduction of electromagnetic waves, normally microwaves, of a determined frequency a plasma is established in the void and light is emitted via the Faraday cage.

In our so-called "LER" patent application No. EP2188829, there is described and claimed (as granted):

A light source to be powered by microwave energy, the source having:

- a body having a sealed void therein,
  - a microwave-enclosing Faraday cage surrounding the body,
- the body within the Faraday cage being a resonant waveguide,
- a fill in the void of material excitable by microwave energy to form a light emitting plasma therein, and
- an antenna arranged within the body for transmitting plasma-inducing, microwave energy to the fill, the antenna having:
  - a connection extending outside the body for coupling to a source of microwave energy;

wherein:

- the body is a solid plasma crucible of material which is lucent for exit of light therefrom, and
- the Faraday cage is at least partially light transmitting for light exit from the plasma crucible, the arrangement being such that light from a plasma in the void can pass through the plasma crucible and radiate from it via the cage.

As used in Our LER Patent:

"lucent" means that the material, of the item which is described as lucent, is transparent or translucent—this meaning is also used in the present specification in respect of its invention;

"plasma crucible" means a closed body enclosing a plasma, the latter being in the void when the void's fill is excited by microwave energy from the antenna.

One alternative to the LER technology is our so-called "Clam Shell", which is the subject of our International Patent Application No PCT/GB08/003811. This describes and claims (as published):

A lamp comprising:

- a lucent waveguide of solid dielectric material having:
  - a bulb cavity,
  - an antenna re-entrant and
  - an at least partially light transmitting Faraday cage and
- a bulb having a microwave excitable fill, the bulb being received in the bulb cavity.

The fabrication of a LUWPL can be of continuous solid-dielectric material between opposite sides of the Faraday cage (with the exception of the excitable-material and closed void) as in a lucent crucible of our LER. Alternatively it can be effectively continuous as in a bulb in a bulb cavity the "lucent waveguide" of our Clam Shell. Alternatively again fabrications of our International patent application no. PCT/GB2011/001744 and other as yet unpublished applications on improvements in our technology include insulating spaces distinct from the excitable-material, closed void.

Accordingly it should be noted that whereas terminology in this art, prior to out LERs, includes reference to an electroplated ceramic block as a "waveguide" and indeed the lucent crucible of our LER has been referred to as a "waveguide". However in the this specification, we use "waveguide" to indicate jointly:

- the enclosing Faraday cage, which forms the wave guide boundary, and
- within the cage, the fabrication including its solid-dielectric lucent material and the void, which material influences the manner of propagation of the waves inside the cage.

Further in our International Patent Application No. PCT/GB2010/000911, there is described and claimed (as published):

A light source to be powered by microwave energy, the source having:

- a solid plasma crucible of material which is lucent for exit of light therefrom, the plasma crucible having a sealed void in the plasma crucible,
- a Faraday cage surrounding the plasma crucible, the cage being at least partially light transmitting for light exit from the plasma crucible, whilst being microwave enclosing,
- a fill in the void of material excitable by microwave energy to form a light emitting plasma therein, and
- an antenna arranged within the plasma crucible for transmitting plasma-inducing microwave energy to the fill, the antenna having:
  - a connection extending outside the plasma crucible for coupling to a source of microwave energy;

the light source being characterised by the inclusion of:

- a source of microwaves at a frequency to excite resonance within the lucent crucible and the Faraday cage for excitation of a light emitting plasma in the sealed void and
- a waveguide for coupling microwaves from the generator to the antenna, the waveguide being:

substantially two or more half wave lengths long and having:

a waveguide input from the generator positioned close to an input end of the waveguide and a waveguide output to the antenna connection positioned close to an output end of the waveguide.

Herein we refer to the generator-to-antenna waveguide as a "transition waveguide".

In our International patent application No PCT/GB2010/001518, we have described and claimed:

A luminaire having:

a plasma light source powered by High Frequency (HF) power;

a HF power supply having a physical structure, the light source and the HF-power-supply physical structure being connected together as an assembly;

a housing for the HF power supply, the said assembly and the housing being fastened together and the housing having:

an aperture through which the said assembly extends with cooling air flow clearance and a cooling air fan arranged at an opening in the housing for drawing air in (or out) for cooling of the HF power supply and passage out (or in) via the aperture and past the light source; and a reflector for at least substantially collimating light from the light source fastened to the housing at the aperture and the reflector having its own aperture through which the said assembly extends, with the light source arranged within the reflector.

This was drafted before we defined a LUWPL. We refer to this luminaire as "our First Luminaire". It was intended to include an LER LUWPL.

We have also applied for patents on the drive circuitry for the magnetron which is central to the present invention. Whilst the details are again not important for the present invention, we would say that the principal one of these circuitry applications is our International Patent Application No. PCT/GB2011/000920, which describes and claims (as published):

A power supply for a magnetron comprising:

a DC voltage source;

a converter for raising the output voltage of the DC voltage source, the converter having:

a capacitative-inductive resonant circuit, a switching circuit adapted to drive the resonant circuit at a variable frequency above the resonant frequency of the resonant circuit, the variable frequency being controlled by a control signal input to provide an alternating voltage, a transformer connected to the resonant circuit for raising the alternating voltage, a rectifier for rectifying the raised alternating voltage to a raised DC voltage for application to the magnetron;

means for measuring the current from the DC voltage source passing through the converter;

a microprocessor programmed to produce a control signal indicative of a desired output power of the magnetron; and an integrated circuit arranged in a feed back loop and adapted to apply a control signal to the converter switching circuit in accordance with a comparison of a signal from the current measuring means with the signal from the microprocessor for controlling the power of the magnetron to the desired power.

Whilst our LUWPL technology is in generally efficient in terms of lumens of light produced per watt of electricity consumed in its operation, they still dissipate a considerable wattage of heat that must be dissipated, to avoid components overheating. Magnetrons are particularly susceptible to overheating, significantly losing efficiency of microwave generation if their magnets are overheated.

Equally, we have sought to avoid use of cooling fans where possible in lamps using our LUWPL technology.

Conventionally magnetrons, particularly as used in microwave cookers, are cooled by forced air flow through a series of cooling fins attached to the anode of a magnetron. We are aware of a proposal to conduct heat from an anode for remote dissipation. This is in European Patent Application No 1,355,340, whose abstract is as follows:

Magnetron including a cylindrical anode (11) having a resonant space formed therein and a cathode fitted therein, magnets (12*a*,12*b*) fitted to upper and lower sides of the anode (11), a yoke (1) fitted on outsides of the anode (11) and the magnets (12*a*,12*b*) to form a closed circuit, and cooling devices including a main cooling device to form a heat discharge path from the anode (11), and a supplementary cooling device (60) to form a heat discharge path from the magnet (12*b*) direct or indirectly, wherein the main cooling device is an anode heat conductor (50) having one end closely fitted to an outside surface of the anode (11), and the other end passed to the yoke (1) and exposed to an external air, and the supplementary cooling device includes a magnet heat conductor (60) closely fitted to an outside surface of the magnet (12*b*), the magnet heat conductor (60); having one side in contact with the outside case (41) of the magnetron, or a yoke heat conductor (70) closely fitted to an outside surface of a yoke plate, the yoke heat conductor (70) having one side in contact with the outside case of the magnetron (41).

SUMMARY OF THE INVENTION

The object of the present invention is to provide a LUWPL without forced convective cooling.

According to the present invention there is provided a Lucent Waveguide Plasma Light source to be supported by a support comprising:

a fabrication of solid-dielectric, lucent material, having;

a closed void containing electro-magnetic wave, normally microwave, excitable material; and a Faraday cage:

delimiting a waveguide, being at least partially lucent, and normally at least partially transparent, for light emission from it, normally having a non-lucent closure and enclosing the fabrication;

provision for introducing plasma exciting electro-magnetic waves, normally microwaves, into the waveguide;

the arrangement being such that on introduction of electromagnetic waves of a determined frequency a plasma is established in the void and light is emitted via the Faraday cage;

wherein the said provision includes:

a transition waveguide providing for introduction of plasma exciting microwaves into the void-containing-waveguide delimited in the lucent body by the Faraday cage and a magnetron for generating microwaves to excite a light emitting plasma in the void in the lucent waveguide formed by the fabrication and the Faraday cage;

wherein there is included:

a finned heat dissipation member for dissipating heat from the magnetron to the ambient atmosphere and means on the dissipation member for heat conductingly clamping the heat dissipation member to an anode and/or magnets of the magnetron; and wherein:

the heat dissipation member supportingly connects the magnetron, transition waveguide and the lucent fabrication to the support, whereby the fins define a heat dissipating, convective airway through the said member which is a support-and-dissipation member.

It can be envisaged that the means on the heat dissipation member for heat conductively clamping the heat dissipation member to the anode and/or magnets of the magnetron may include heat pipes, it is preferable that the means is comprised entirely of a clamp having two parts, one part being formed integrally with the support-and-dissipation member and the other part being fixed around the anode/magnets. In the preferred embodiment, the two parts are formed complementarily with the anode and clamped together and onto the anode by clamp screws.

It is envisaged that the heat dissipating support structure may support the microwave guide structure entirely by means of the clamp. However, as in the preferred embodiment, additional, direct attachment of the two structures may also be provided. This may be with the interposition of a bracket. Where the heat conduction from the anode/magnets is by a less substantial conductor, the additional attachment means becomes essential. It is also envisaged that the additional attachment could be indirect, that is via an intermediary member, such as a cover or casing of the light source attached to the heat dissipating structure and having the microwave guide structure attached to it, possibly with the interposition of a bracket.

In the first preferred embodiment described below the fins in the support structure extend in generally the same direction from a separate support member. As such they actually support the microwave guide structure, with some of the fins or all of them as in the preferred embodiment of the fins extending from the separate support member to the microwave guide structure. Again as in the preferred embodiment, the ends of the fins remote from the microwave guide structure are connected together for fixture to the separate support member.

In the second embodiment, in which the fins extend from a central hub, clamped to the magnetron, the light source can be suspended from a suspension point on the hub. Alternatively, light source can be suspended by one or more suspension points attached to the distal ends of the fins. In the second preferred embodiment, these are integrally connected together in a rim of their casting, the rim being connected to an outer cover, suitably perforated for allowing the convective air flow. Alternatively the distal ends other fins can be circumferentially free from each other in their casting, but held in the casing. In either of these cases, the light source can be suspended from an upper point in the casing.

In the third embodiment, some details of which have been disclosed in the April 2012 Lighting Magazine—www.lighting.co.uk—the support-and-dissipation member is generally plate shaped, with its fins extending from its top side and its clamping means being on its underside. An enclosure for the transition waveguide and the magnetron supports a reflector for reflecting light from the plasma in the void.

The fins are preferably curved to increase their surface area for heat dissipation. Further they preferably radiate from a "central" boss, positioned above the clamping means. Since the magnetron will normally be offset from a central optical axis of the light source, the clamping means and "central" boss will be equally offset. Nevertheless, the boss can be sufficiently extensive to provide a suspension point on the optical axis.

Normally the luminaire will be suspended from above, being supported from a support point on or attached to the heat dissipating member, with the fins extending upwardly from the heat dissipating member. Conveniently they radiate in a straight or curved fashion from a boss. The boss is preferably cored for lightness. Further in the preferred embodiment in which the magnetron anode and/or magnets is/are eccentric from a central axis of the luminaire, the boss is arranged above the heat conductive attachment.

In contrast to our First Luminaire, we prefer to provide an enclosure for the reflector, with the reflector supported at a bottom rim of the enclosure and extending up to the fabrication having the plasma void.

BRIEF DESCRIPTION OF THE DRAWINGS

To help understanding of the invention, a specific embodiment thereof will now be described by way of example and with reference to the accompanying drawings, in which.

DETAILED DESCRIPTION OF THE PREFERRED EMBODIMENTS

Figure 1:
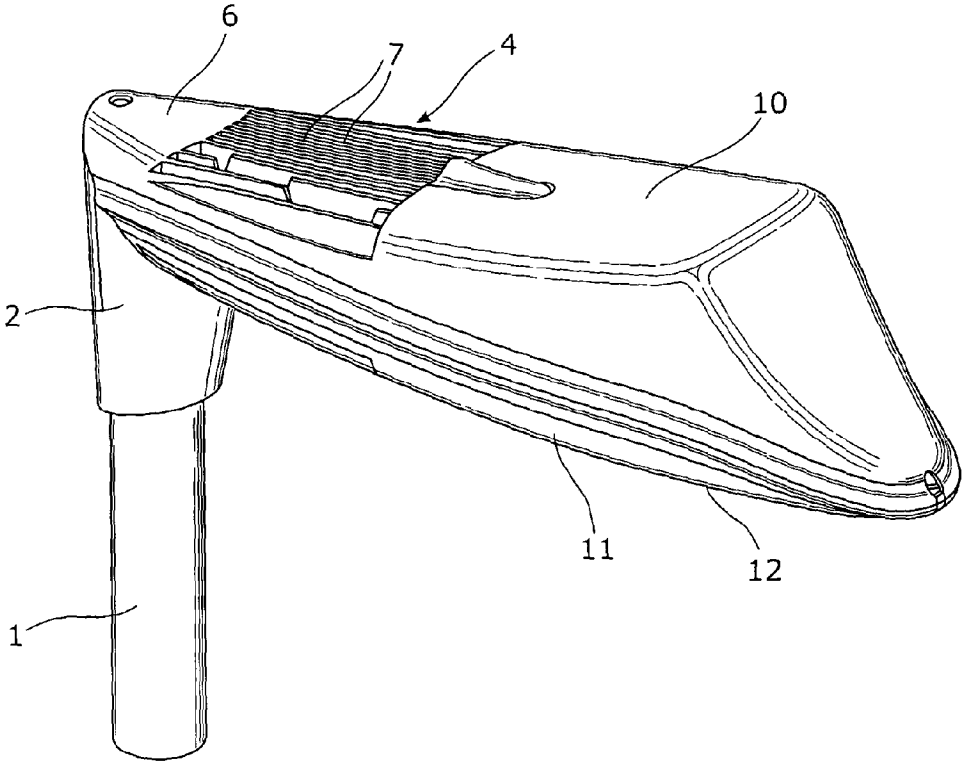
FIG. 1 is a perspective view from above and one side of a Lucent Waveguide Plasma Light Source in accordance with the invention.
Figure 2:
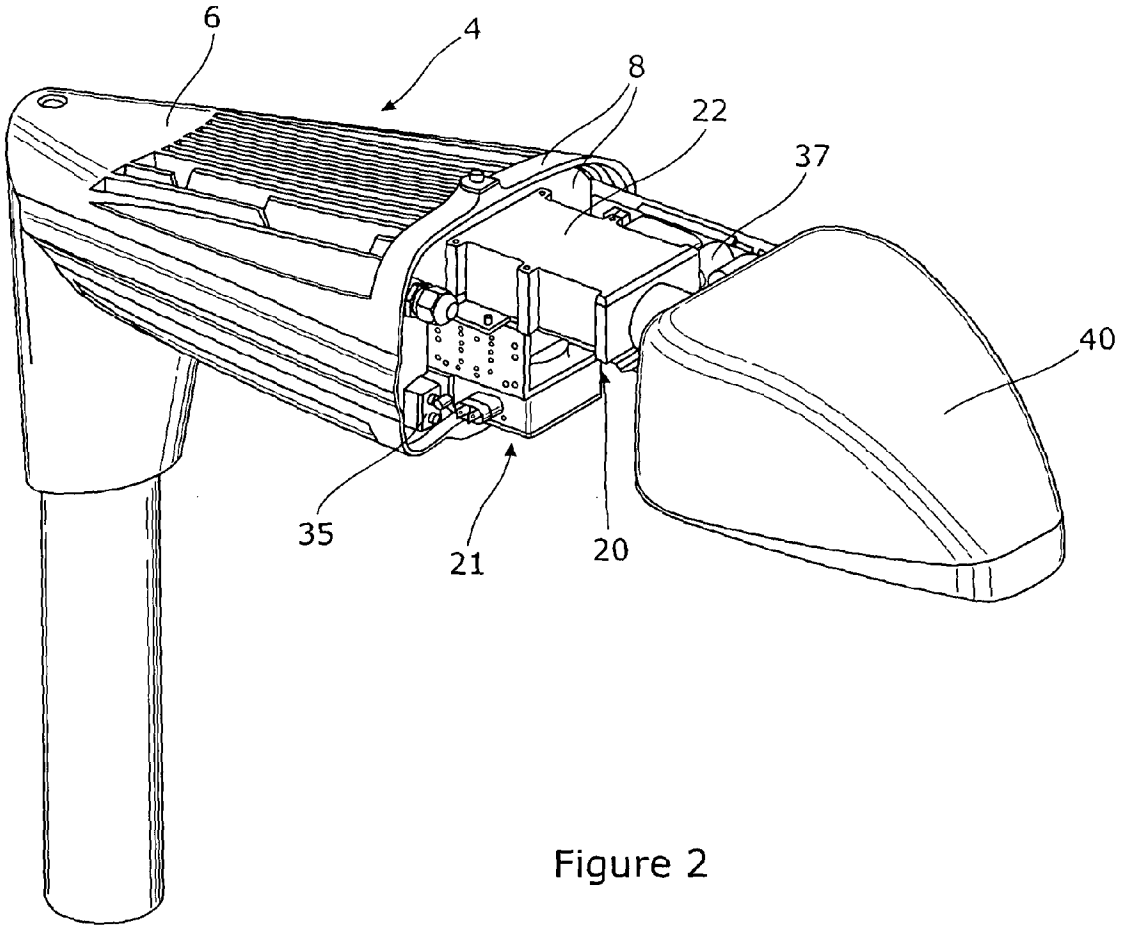
FIG. 2 is a similar view to that of FIG. 1 of the LUWPL with front top and bottom covers removed.
Figure 3:
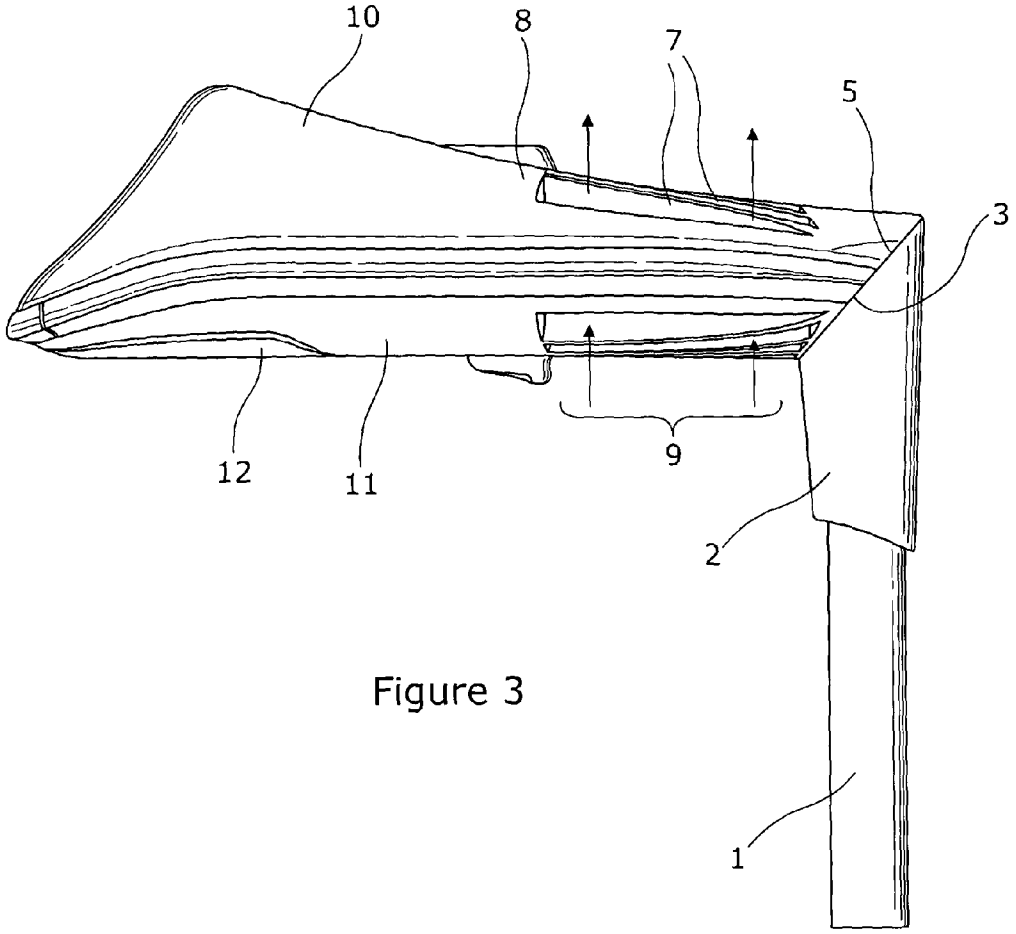
FIG. 3 is an opposite side view of the LUWPL of FIG. 1.
Figure 4:
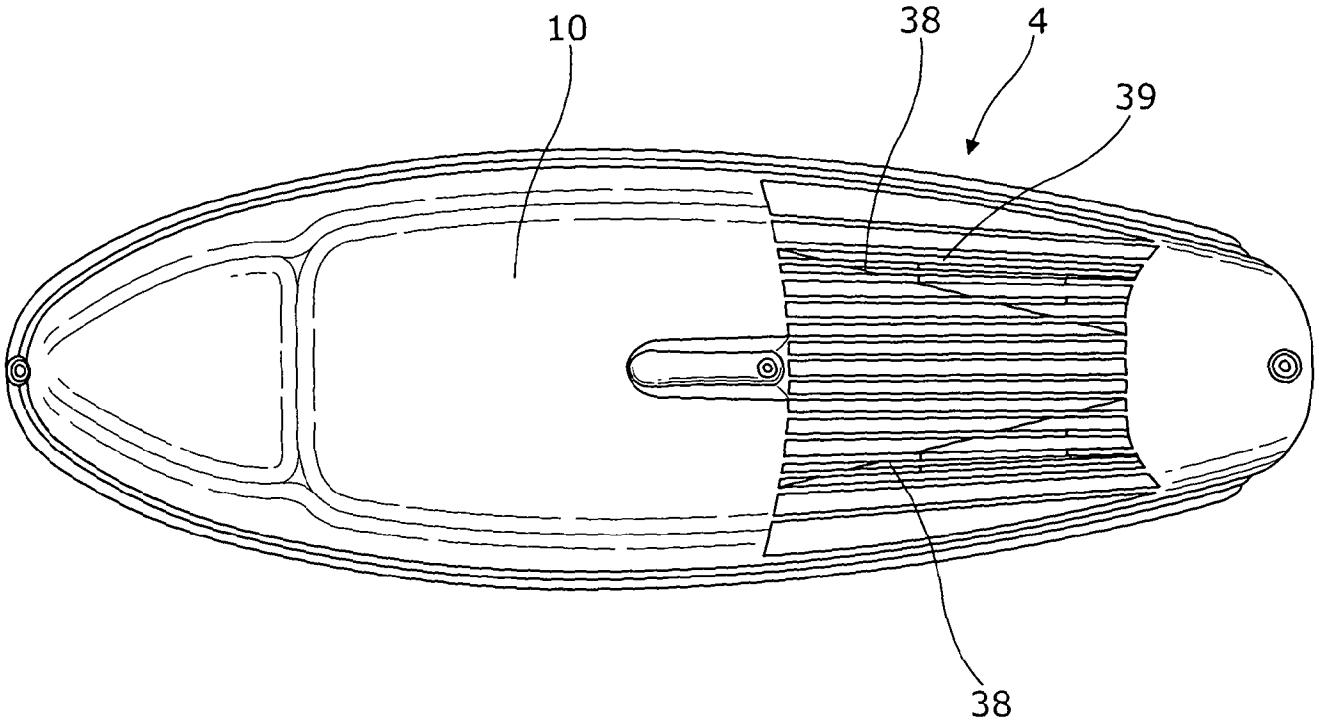
FIG. 4 is a plan view of the LUWPL.
Figure 5:
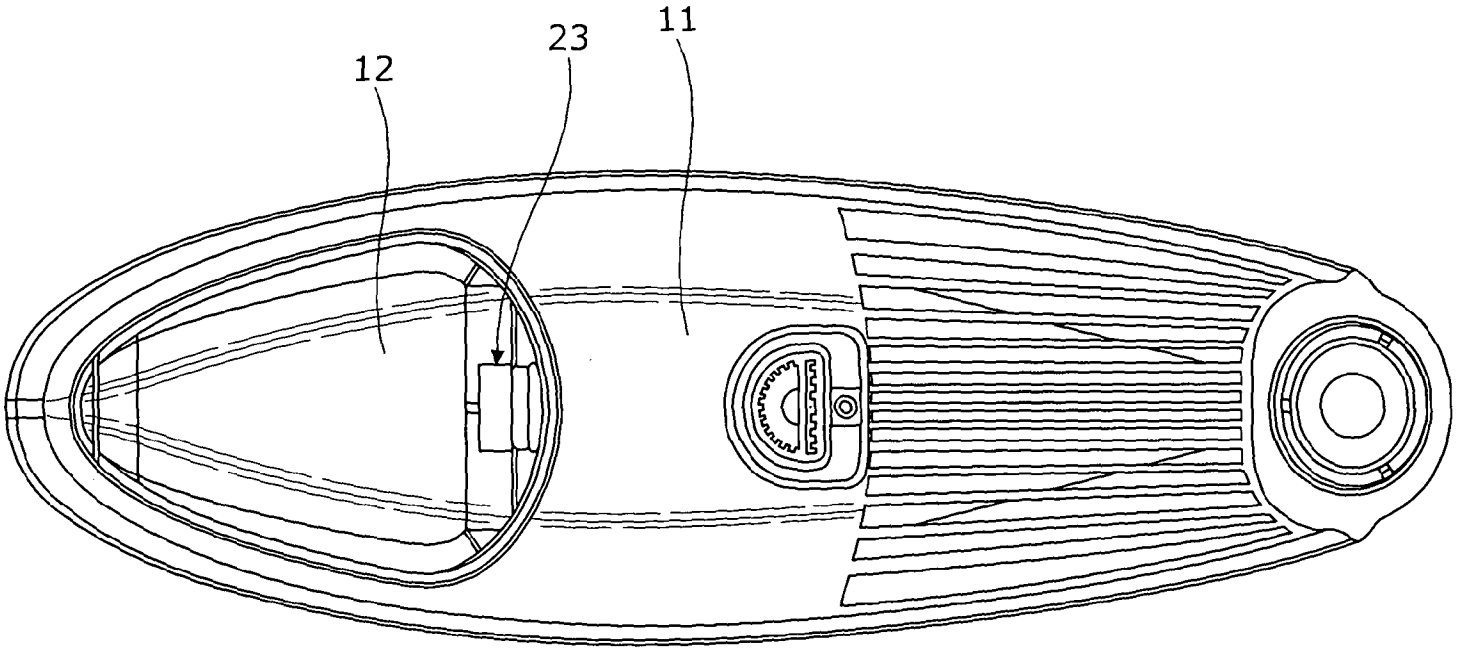
FIG. 5 is an underneath view of the LUWPL.
Figure 6:
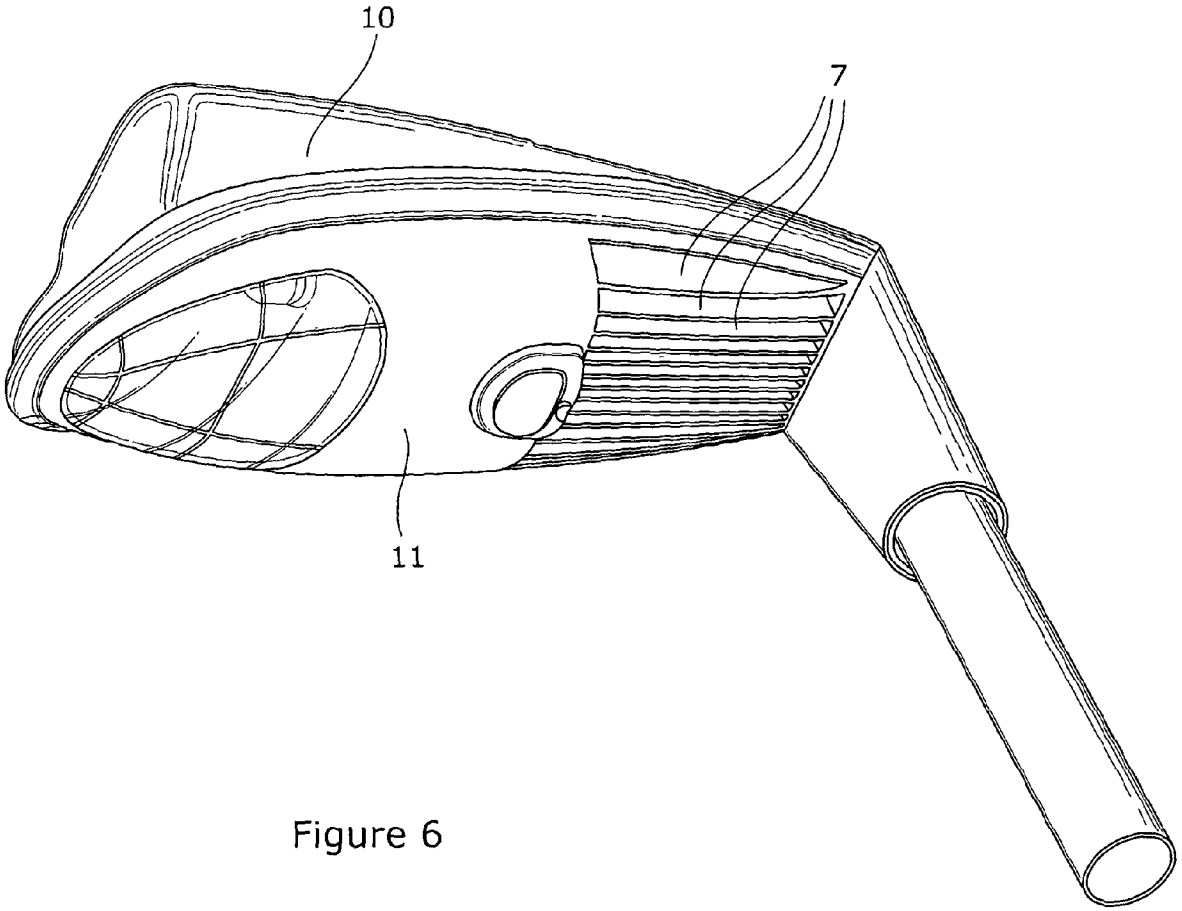
FIG. 6 is an underneath perspective view from the side of FIG. 3 of the LUWPL.
Figure 7:
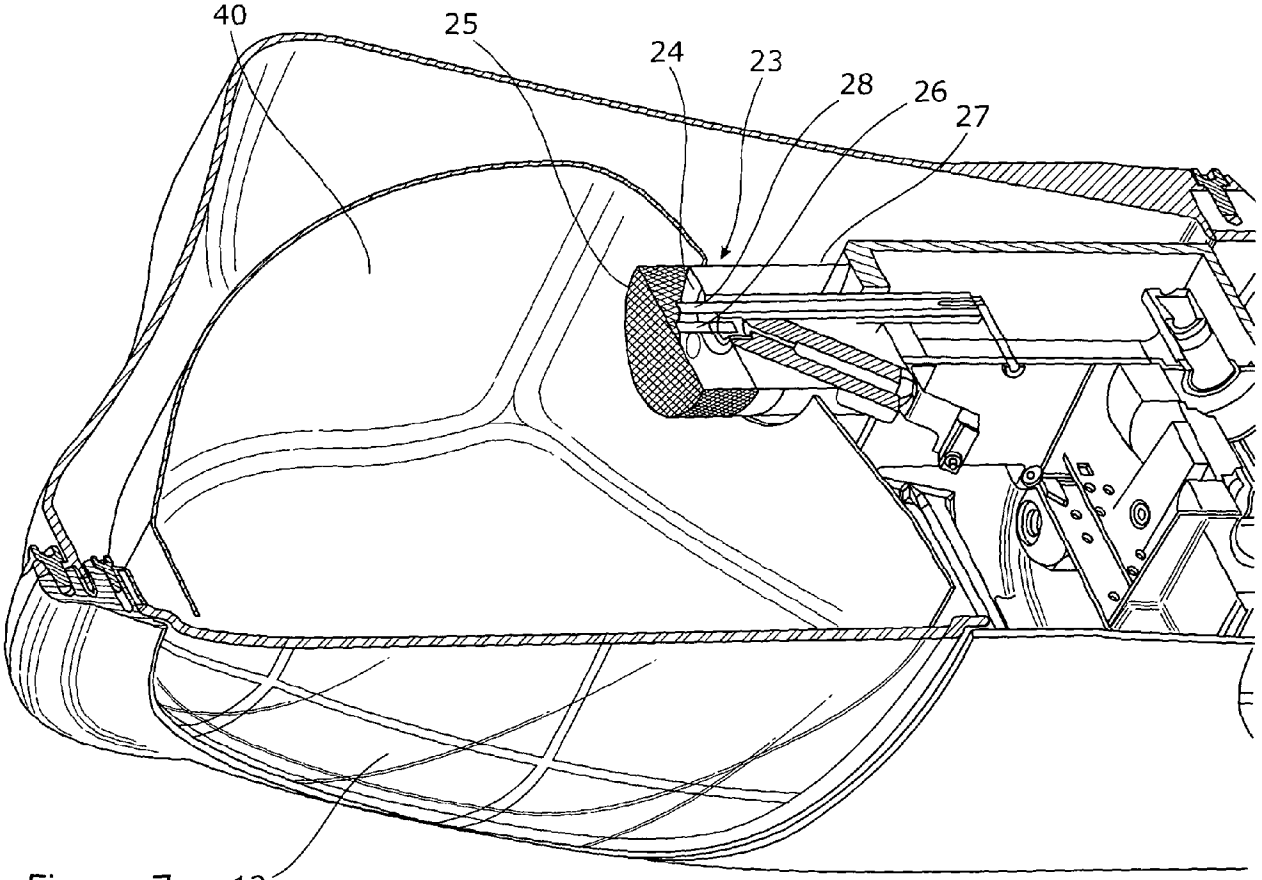
FIG. 7 is a central, vertical cross-sectional view from the angle of FIG. 6 of the LUWPL, on a more detailed scale showing a reflector.
Figure 8:
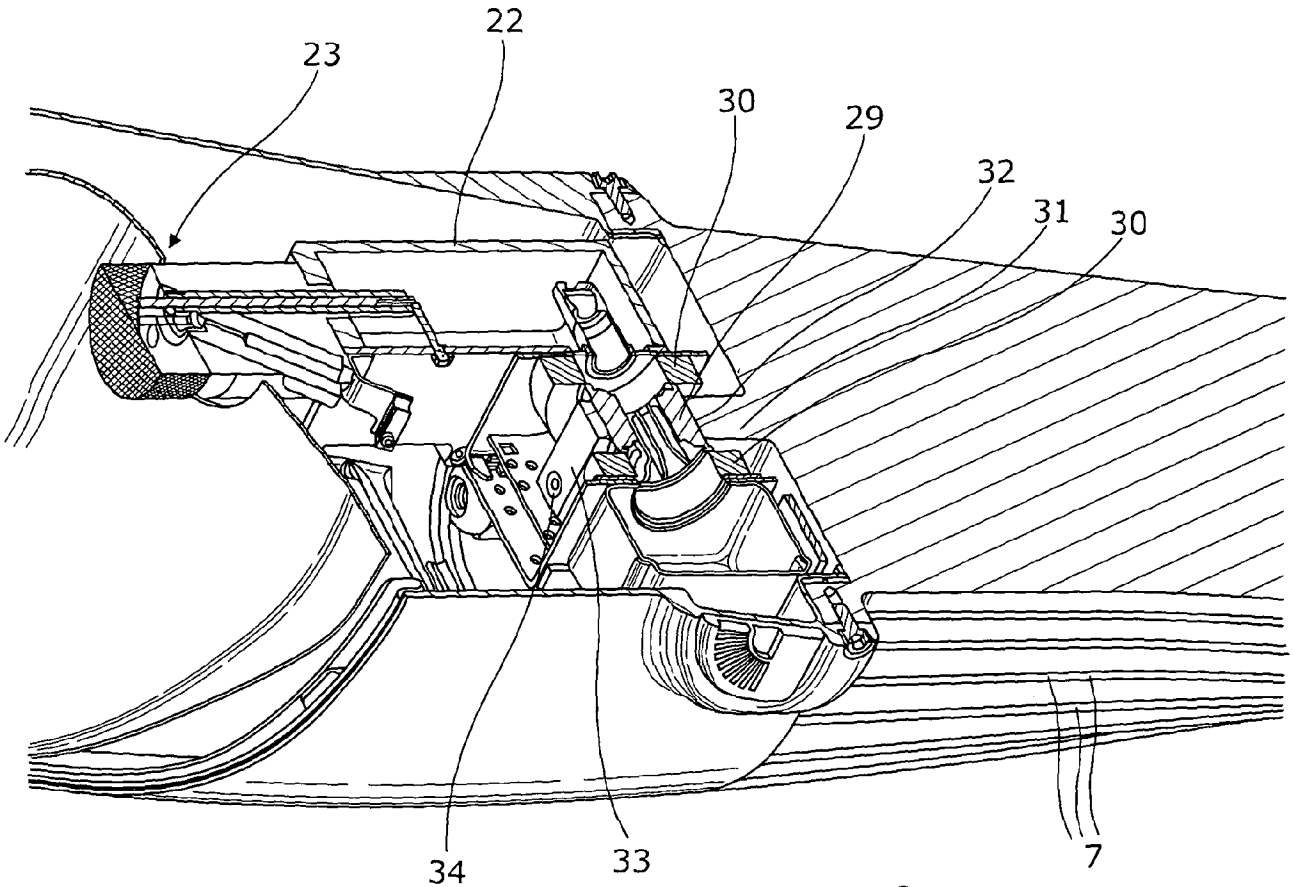
FIG. 8 is a cross-sectional view on the same plane through a microwave guide structure of the LUWPL.
Figure 9:
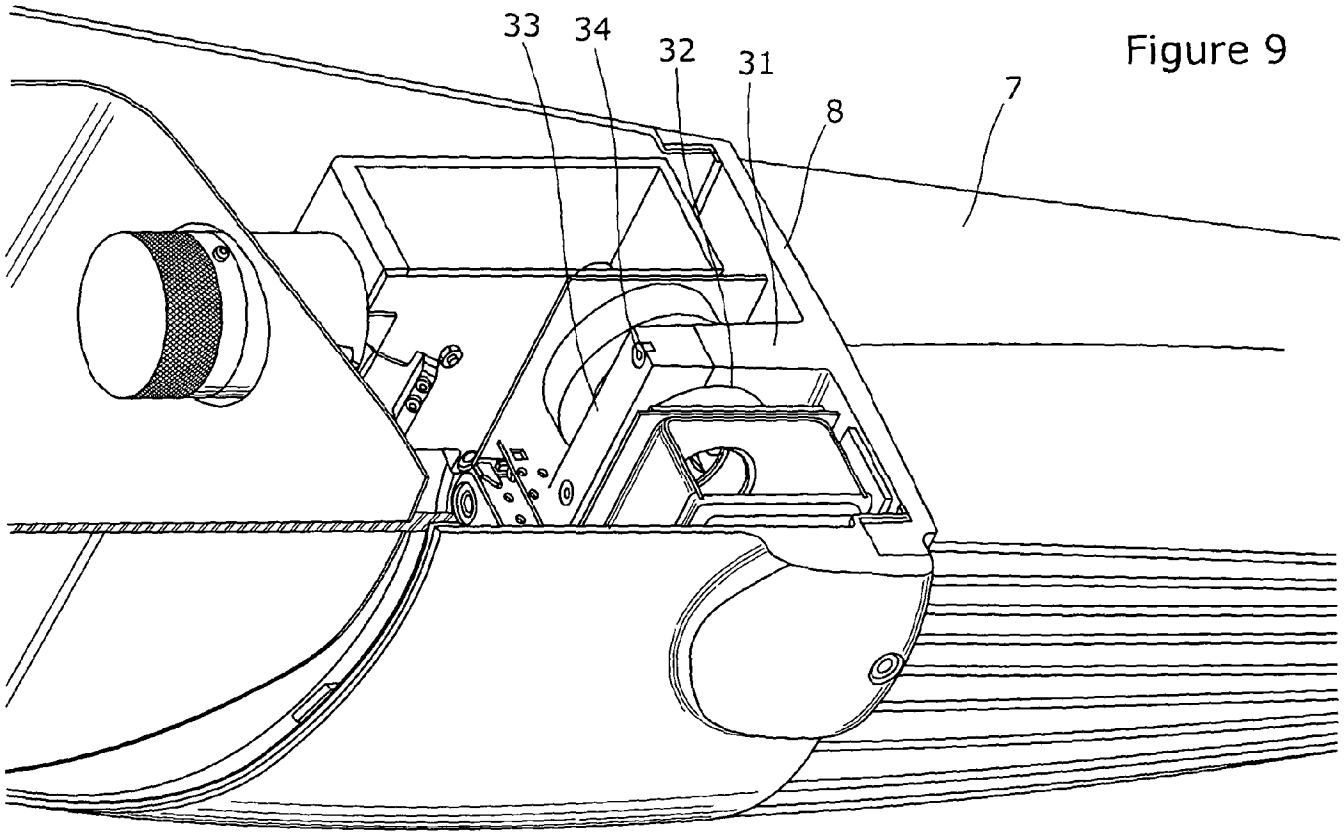
FIG. 9 is a similar cross-sectional view to that of FIG. 8 on a nearer plane.
Figure 10:
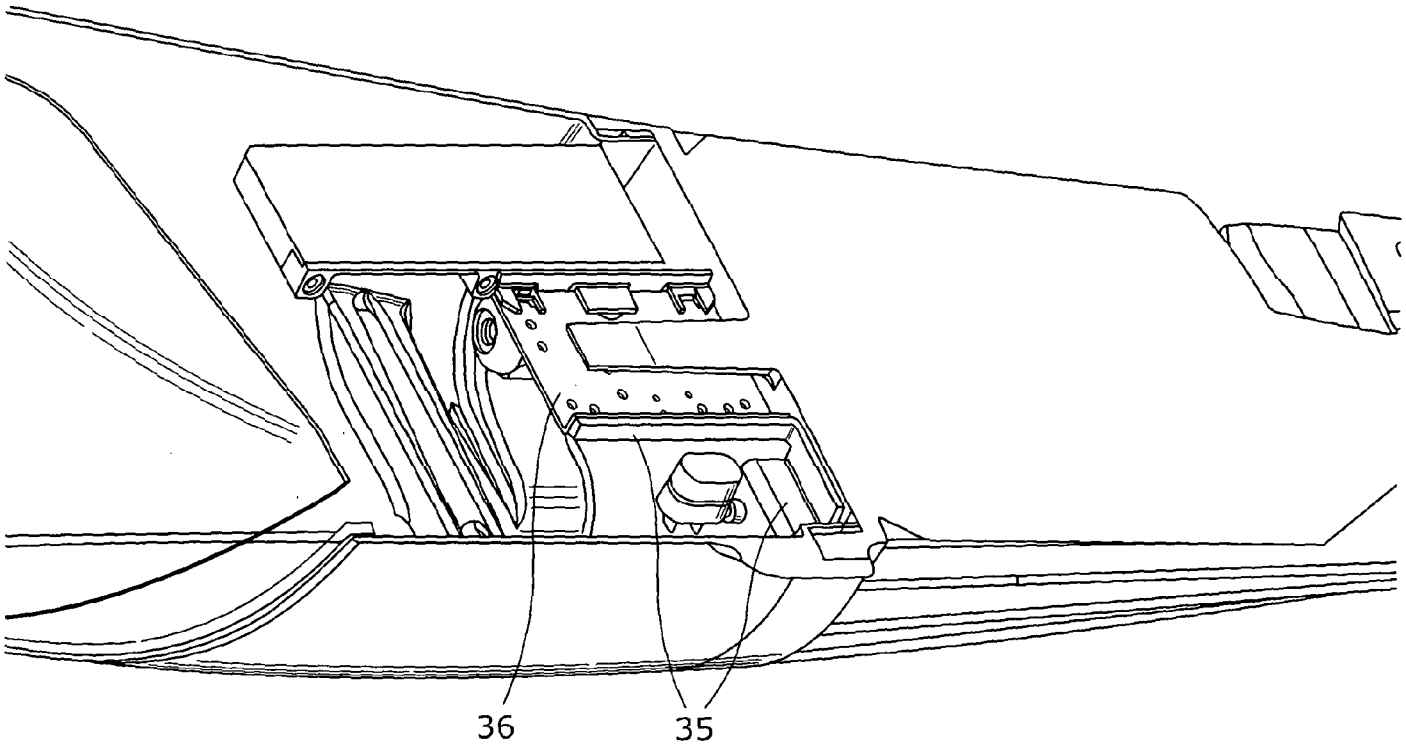
FIG. 10 is a similar cross-sectional view to that of FIG. 8 on a further plane.

Referring first to FIGS. 1 to 10 of the accompanying drawings, a Lucent Waveguide Plasma Light Source is configured as a street light, for support on a lamp standard 1. The LUWPL has a lamp standard adapter 2 presenting a face 3 angled at 45°. In a non-shown alternative, the adapter may be substituted for a wall bracket also presenting a 45° face. A heat dissipating support structure 4 has a complementarily angled face 5. The adapter 2 and the structure 4 are bolted together with their 45° faces abutting.

The structure 4 is an integral aluminium casting having a boss 6 presenting the angled face 5, a series of substantially vertically oriented fins 7 and a hub 8. The fins close together in their extent from the hub to the flange and also taper in their height. Within them, the fins define a vertically extending convective airway 9, indicated in FIG. 3 by airflow arrows.

At the hub 8, the contour of the fins is continued by an upper cover 10 and a lower cover 11, in which is provided a transparent lens 12. The covers are bolted together and to the hub, with the inter-position of seals.

Within the covers is arranged a microwave guide structure 20 comprising a magnetron 21, fast with a transition waveguide 22, and an LER 23. The latter consists of a lucent crucible 24 within a Faraday cage 25 closely surrounding it so that the crucible provides a resonant waveguide. Centrally it has a void 26 containing excitable material. An aluminium carrier 27 extends from the transition, with which it is fast. The Faraday cage is fastened to the carrier holding the crucible to it. Centrally of the carrier an antenna 28 extends from within the transition and into the crucible. As will be appreciated the microwave guide structure is a cohesive whole, with its components securely fastened together for structural integrity and maintenance of tuned microwave operation.

The magnetron as such has an anode structure 29, on which two circular cylindrical magnets 30 are mounted.

The hub 8 has an integrally cast boss 31, with a semi-circular cut-out 32 machined with a radius complementary to that of the anode structure. A cap 33 is similarly machined and is clamped by screws 34 to the boss, captivating the anode structure in heat conductive contact. To obviate the possibility of deflection, a bracket 35 is fastened to the hub and a magnetron support 36 of the transition, with which the magnetron is fast.

Drive circuitry 37 for the magnetron is arranged alongside the magnetron and the transition. Power to the circuitry is provided via non-shown cables running along webs 38 in the airway 9 between certain of the fins, the cables passing through notches 39 in these fins.

In use the circuitry powers the magnetron to generate microwaves which are transferred to the lucent crucible and excite a light emitting plasma in the void. Light radiates through the Faraday cage to a reflector 40 and thence down through the lens 12. In the process, the anode heats up. The boss 31 and the hub 8 provide a short conduction path to the fins 7. These lose heat convectively to air in the convective airway 9. The number, height and surface area of the fins is matched to the power of the light source. For a 250 W light source, that is 250 W applied by to the magnetron, we provide 13 fins of approximately 240×160×10 mm plus 2 thicker edge fins.

The reflector is symmetric in cross-section through the LER to disperse light equally on either side of the latter. However, it is asymmetric in longitudinal cross-section, with its portion close to the transition arranged substantially upright. This provides that whilst light is directed away from the pole on which the LUWPL is supported little light is directed at or behind the pole.

Figure 11:
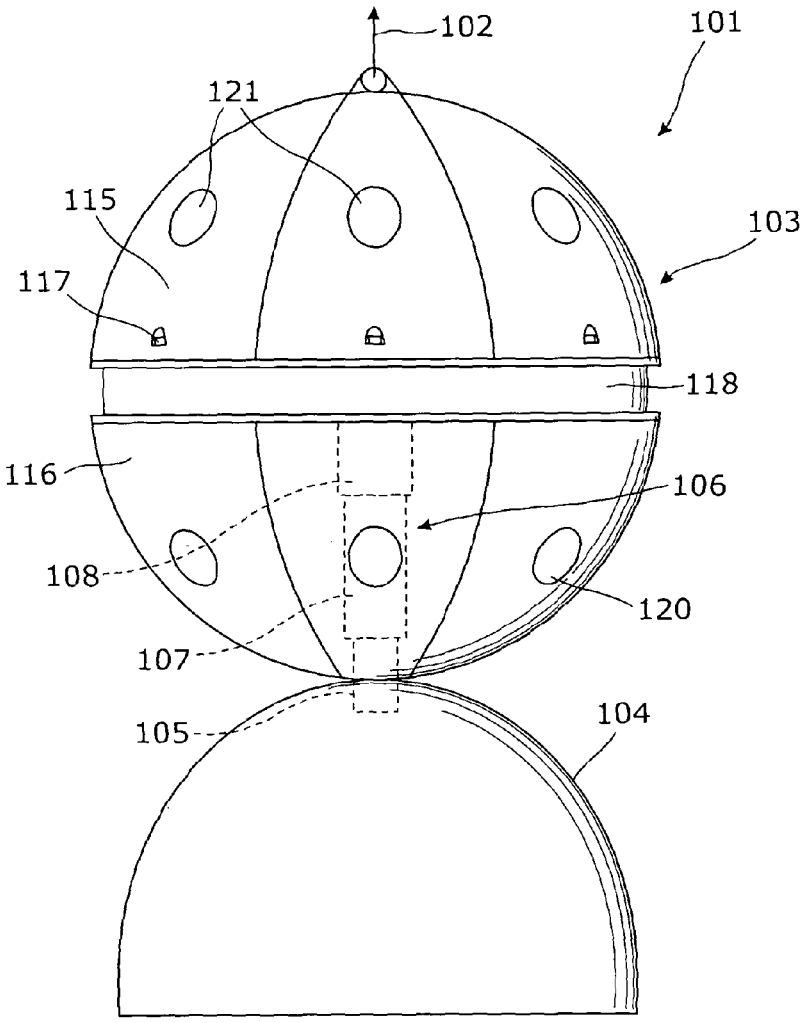
FIG. 11 is a side view of a second LWMPLS according to the invention.
Figure 12:
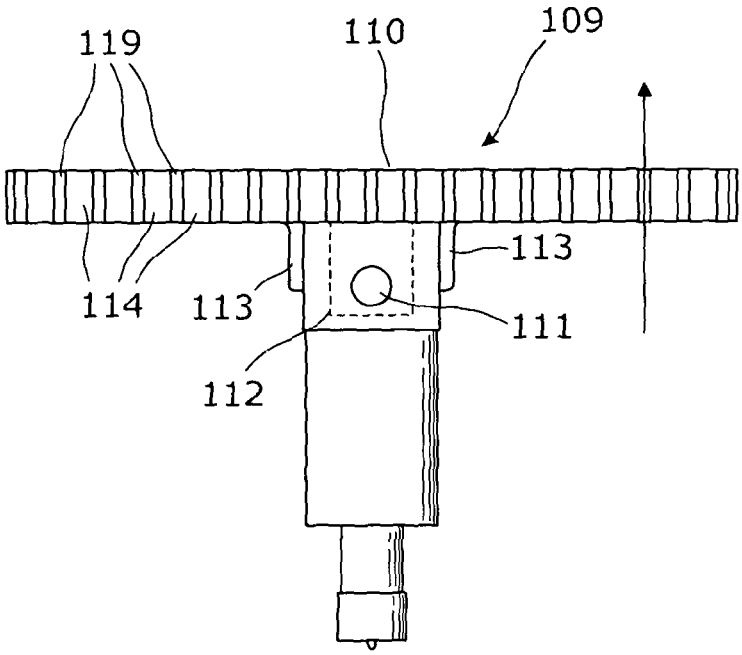
FIG. 12 is a similar side view of the a heat dissipating support structure and the microwave guide structure of the LWMPLS of FIG. 11.
Figure 13:
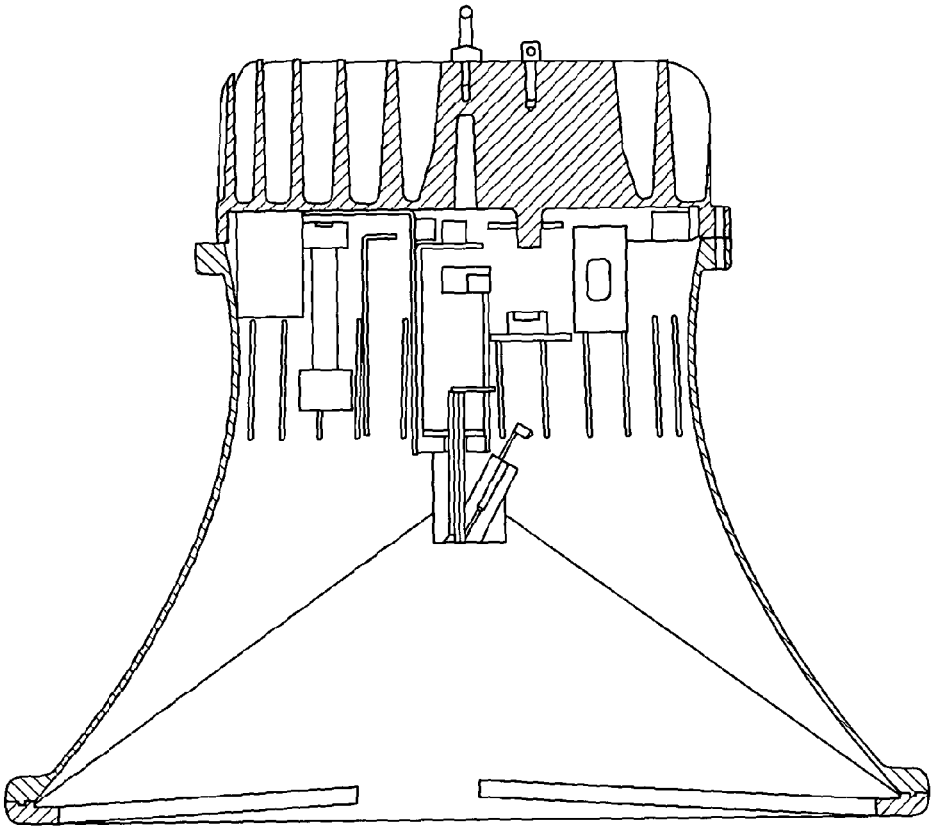
FIG. 13 is a reproduction of an page published in the Lighting magazine intermediate the date of our Patent Application No 1117409.1 and the date of the present application.
Figure 14:
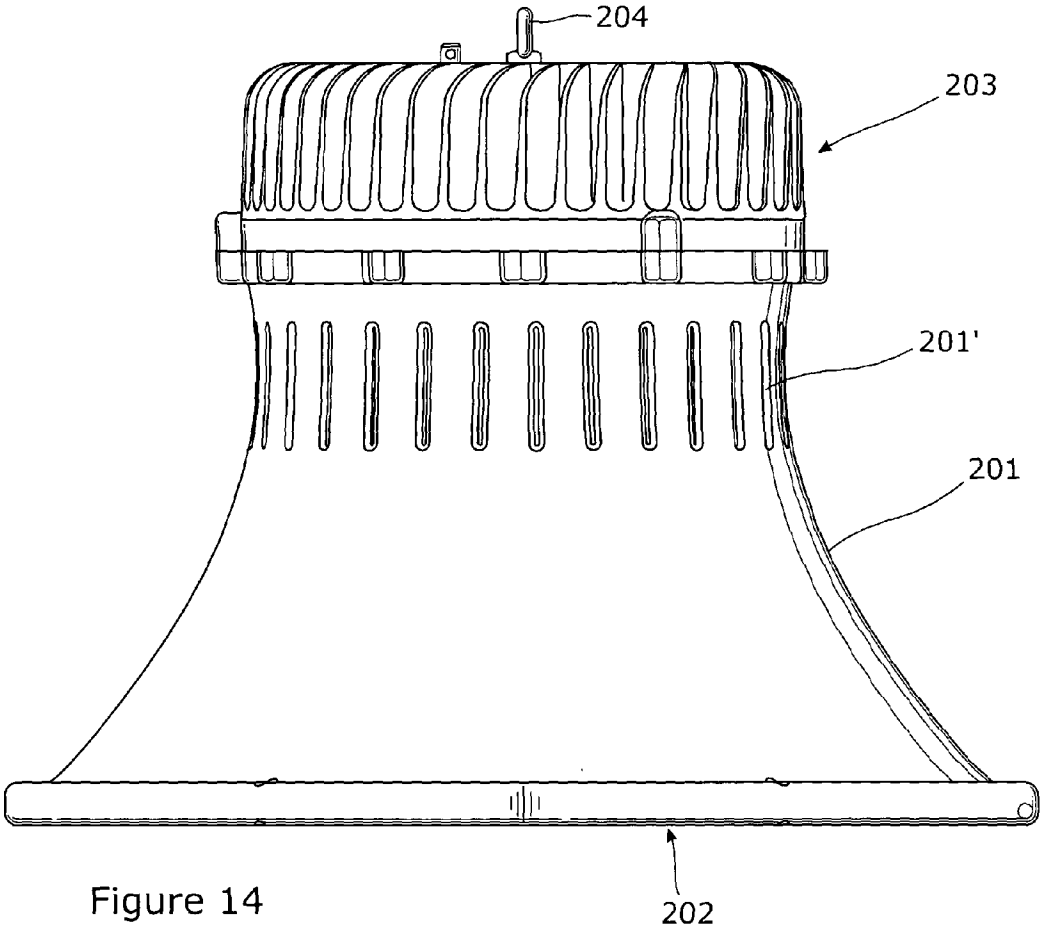
FIG. 14 is a side view of an LER LUWPL luminaire of a third embodiment of the present invention.

Turning now to FIGS. 11 and 12, a second LUWPL 101 is shown suspended from a cable 102, fast to the top of a casing 103, below which a reflector 104 is arranged. An LER 105 is supported within the casing with its void at the focal point of the reflector. The LER is part of a microwave guide structure 106, as in the first embodiment, including a transition waveguide 107 and a magnetron 108.

Centrally arranged in the casing is a heat dissipating support casting 109. It has a central hub 110 to which the magnetron anode 111 is clamped 112. An additional support bracket 113 is provided from the hub to the transition wave guide 107. Radiating from the hub are a series of fins 114, which extend as far as a joint between an upper part 115 and lower part 116 of the casing. These are clamped together with screws 117 with an enclosure strip 118 closing the gap between the parts at the tips 119 of the fins. Thus there is a convective airway up through the fins. The lower part has air entry apertures 120 and upper part has air exit apertures 121.

It will thus be seen support of the LER is via:

1. The cable 102,
2. The casing 103,
3. The fins 114 and the hub 110 of the heat dissipater and
4. The transition wave guide 107 which is fast with the heat dissipater.

Referring to the FIGS. 13 to 16 of the drawings, a LUWPL luminaire has a housing 201 with a lower transparent closure 202 and a heat dissipating top 203, of cast aluminium. This has a suspension eye 204. (NB. The slots 201' shown in the drawings will not be provided in production versions of the luminaire which will be sealed.)

The housing has an upper flange 205 via which it is bolted with the interposition of a seal 206 to a underside rim 207 of the top. Within the rim, the underside 208 is substantially flat, with a magnetron attachment boss 209 and other attachment points 210.

The following LUWPL parts are mounted within the enclosure formed by the housing, the closure and the top. Lowermost is a circular cylindrical quartz fabrication/LER lucent crucible 211 with a closed plasma void 212. It is surrounded on its sides and lower face by a Faraday cage 214 and mounted below an aluminium block 215. An antenna 216 passes through the block from an air waveguide transition 217 and terminates in the crucible to one side of the void 212. The transition is an aluminium box into which extends to the output 218 of a magnetron 219. The magnetron, the transition box and the crucible support block are all fast with each other. The magnetron is supported by being clamped by a saddle 220 to the attachment boss 209 at the magnetron's anode, which in a more normal arrangement for magnetron cooling, would be surrounded by cooling fins which are absent. A bracket 221 fixed to certain of the attachment points 210 extends down from the top and is screwed to the transition box. Thus the LUWPL parts are securely supported below the top. Power supply circuitry 222 is secured to other of the attachment points.

Full operational details of the LER LUWPL are not part of this invention. The reader is referred to others of our patents for interest in this connection.

To increase the conduction of heat from the boss 209 to the top 203 and in particular to a hub 223, with which the suspension eye 204 is fast, and to fins 224 cast integrally with it, the boss has appreciable radius of curvature 225 leading from its sides into the underside of the top.

Figure 15:
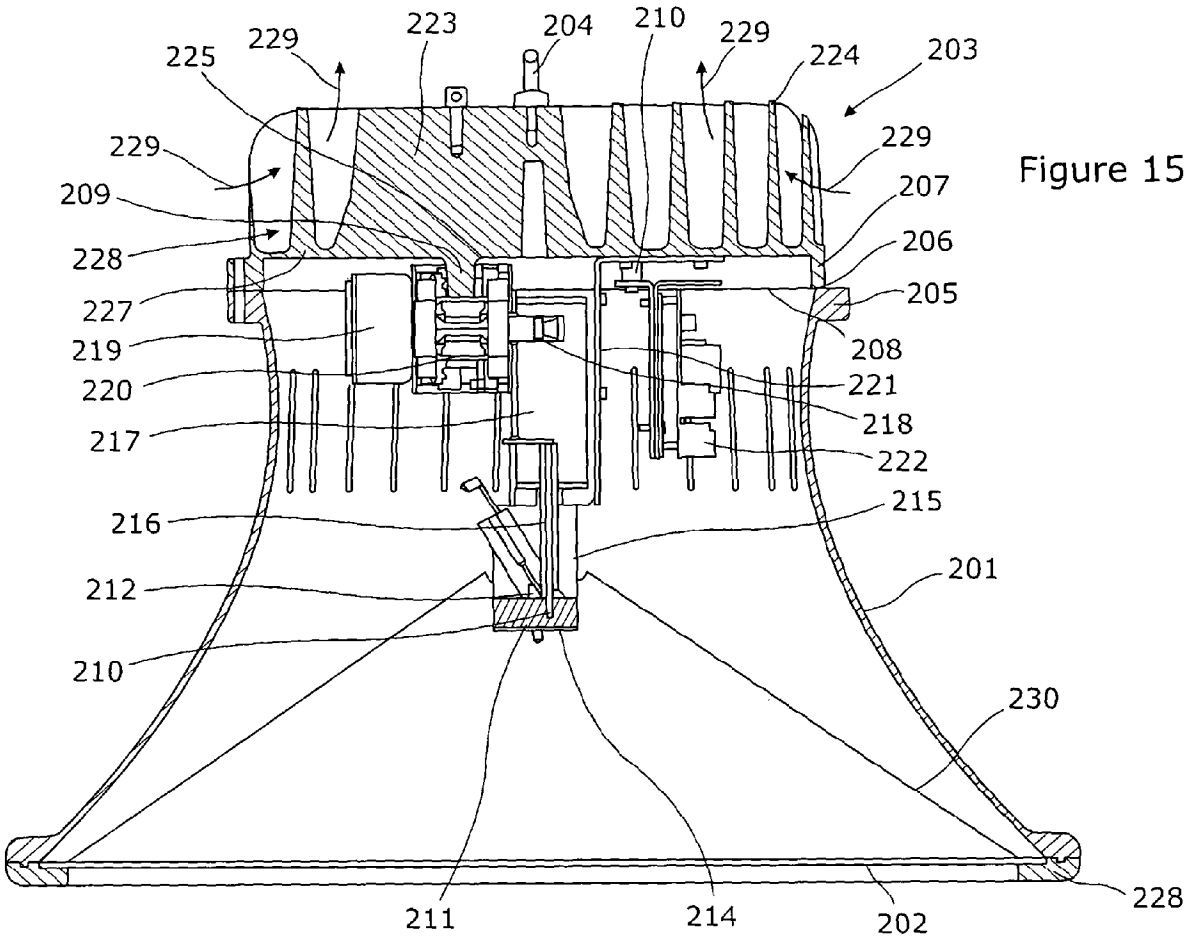
FIG. 15 is a central cross-section view corresponding to the luminaire side view of FIG. 2.
Figure 16:
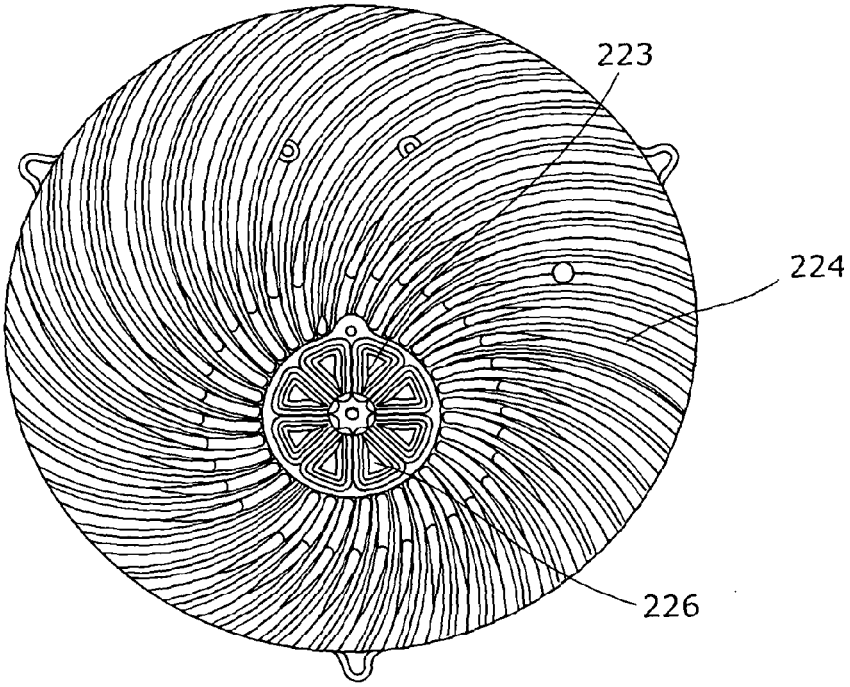
FIG. 16 is a plan view of the heat dissipating top of the luminaire of FIG. 2.

To increase their surface area for heat dissipation the fins 224 are preferably curved when viewed in plan, as shown in FIG. 16. They radiate from the "central" hub 223, which is positioned above the boss 209, as shown in FIG. 15. Since the magnetron will normally be offset from a central optical axis of the light source, the magnetron clamping boss 209 and "central" hub 223 will be equally offset. Nevertheless, the boss can be sufficiently extensive to provide that the suspension eye 204 is on the optical axis/central axis of the luminaire, which is balanced to point straight down. In the interests of weight saving the hub is cored, with central spaces 226.

In use, the magnetron heats up, heating the heat dissipater 203 by conduction. The heat flow is from the boss 209 to a plate 227, the plate 227 having the underside 208 of the dissipater, and to its hub 223. Thence the heat flows into the fins 224. These provide a heating dissipating convective air way 228 for cooling air flowing up the outside of the housing and in to the air way at the radial ends of the slots. In the airway between the slots, the air is heated. Thence it flows out above them. The air flow is shown by exemplary arrows 229.

In contrast to our First Luminaire, through which air flowed and was drawn out by a fan via magnetron anode fins, the transparent closure 202 closes the luminaire. No air can flow through it nor can liquid nor moisture enter it. For providing tightness between the closure 202 and the housing 201, a support moulding 228 is provided. Besides supporting the transparent closure 202, it supports a reflector 230 for collecting light radiating sideways from the lucent crucible and directing it down as an illuminating beam.

The invention is not intended to be restricted to the details of the above described embodiments. For instance, referring to FIGS. 1 to 12, the bracket 35 direct to the structure 4 can be replaced by a suspender of the transition from the upper cover 10.

The invention claimed is:

1. A Lucent Waveguide Plasma Light source to be supported by a support comprising:

a fabrication of solid-dielectric, lucent material, having;

a closed void containing electro-magnetic wave, excitable material; and a Faraday cage:

delimiting a waveguide, being at least partially lucent, and at least partially transparent, for light emission from it, having a non-lucent closure and enclosing the fabrication;

provision for introducing plasma exciting electro-magnetic waves, into the waveguide;

the arrangement being such that on introduction of electromagnetic waves of a determined frequency a plasma is established in the void and light is emitted via the Faraday cage;

wherein the said provision includes:

a transition waveguide providing for introduction of plasma exciting microwaves into a void-containing-waveguide delimited in the lucent body by the Faraday cage and a magnetron for generating microwaves to excite a light emitting plasma in the void in the lucent waveguide formed by the fabrication and the Faraday cage;

wherein there is included:

a finned heat dissipation member for dissipating heat from the magnetron to the ambient atmosphere and means on the dissipation member for heat conductingly clamping the heat dissipation member to at least one of an anode and magnets of the magnetron; and wherein:

the heat dissipation member supportingly connects the magnetron, transition waveguide and the lucent fabrication to the support, whereby the fins define a heat dissipating, convective airway through the said member which is a support-and-dissipation member.

2. A Lucent Waveguide Plasma Light source as claimed in claim 1, wherein clamping means is comprised of two parts, one part being formed integrally with the support-and-dissipation member and the other part being fixed around at least one of the anode and magnets of the magnetron.

3. A Lucent Waveguide Plasma Light source as claimed in claim 2, wherein the two parts of the clamping means are formed complementarily with the anode and clamped together and onto the anode by clamp screws.

4. A Lucent Waveguide Plasma Light source as claimed in claim 1 wherein the support-and-dissipation member supportingly connects the magnetron, transition waveguide and the lucent fabrication entirely by means of the clamping means.

5. A Lucent Waveguide Plasma Light source as claimed in claim 4, wherein the fins form part of the supporting connection for the magnetron, transition waveguide and the lucent fabrication to the support.

6. A Lucent Waveguide Plasma Light source as claimed in claim 1 wherein the support-and-dissipation member supportingly connects the magnetron, transition waveguide and the lucent fabrication by attachment means, separate from the clamping means.

7. A Lucent Waveguide Plasma Light source as claimed in claim 6, wherein the attachment means is a bracket.

8. A Lucent Waveguide Plasma Light source as claimed in claim 1, wherein the fins are curved.

9. A Lucent Waveguide Plasma Light source as claimed in claim 1, wherein the fins are straight.

10. A Lucent Waveguide Plasma Light source as claimed in claim 1, wherein ends of the fins remote from the clamping means are connected together for fixture to the support.

11. A Lucent Waveguide Plasma Light source as claimed in claim 1, wherein the support-and-dissipation member includes a central boss from which the fins radiate.

12. A Lucent Waveguide Plasma Light source as claimed in claim 11, wherein the fins radiate in generally the same direction from the boss.

13. A Lucent Waveguide Plasma Light source as claimed in claim 12, wherein the central boss is cored.

14. A Lucent Waveguide Plasma Light source as claimed in claim 11, wherein the boss is arranged directly above the heat conductive attachment.

15. A Lucent Waveguide Plasma Light source as claimed in claim 11, wherein the boss extends over the optical axis of the Lucent Waveguide Plasma Light source and wherein the boss is provided with a suspension point for the Lucent Waveguide Plasma Light source on the optical axis.

16. A Lucent Waveguide Plasma Light source as claimed in claim 1, wherein the support-and-dissipation member is generally plate shaped, with its fins extending from its top side and its clamping means being on its underside.

17. A Lucent Waveguide Plasma Light source as claimed in claim 1, including an enclosure for the transition waveguide and the magnetron, the enclosure being arranged to support a reflector for reflecting light from the plasma in the void.

* * * * *